US006406364B1

(12) United States Patent
Kimura et al.

(10) Patent No.: US 6,406,364 B1
(45) Date of Patent: Jun. 18, 2002

(54) POLISHING SOLUTION FEEDER

(75) Inventors: Norio Kimura, Tokyo; Hirokuni Hiyama; Yutaka Wada, both of Kanagawa; Kiyotaka Kawashima, Tokyo; Manabu Tsujimura, Tokyo; Takayoshi Kawamoto, Tokyo, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/355,895

(22) PCT Filed: Dec. 8, 1998

(86) PCT No.: PCT/JP98/05541

§ 371 (c)(1),
(2), (4) Date: Oct. 25, 1999

(87) PCT Pub. No.: WO99/29505

PCT Pub. Date: Jun. 17, 1999

(30) Foreign Application Priority Data

Aug. 12, 1997 (JP) ..... 9-354134

(51) Int. Cl.[7] ..... B24B 57/00
(52) U.S. Cl. ..... 451/446; 451/60; 451/910
(58) Field of Search ..... 451/446, 37, 38, 451/60, 285, 286, 287, 288, 289, 290, 41, 910

(56) References Cited

U.S. PATENT DOCUMENTS 4,272,924 A * 6/1981 Masuko et al. ..... 51/165
5,245,790 A 9/1993 Jerbic
5,245,796 A * 9/1993 Miller et al. ..... 51/283 R
5,660,528 A * 8/1997 Tsunenari ..... 417/32
5,664,990 A * 9/1997 Adams et al. ..... 451/60
5,688,364 A 11/1997 Sato
5,791,970 A * 8/1998 Yueh ..... 451/8
5,803,599 A * 9/1998 Ferri, Jr. et al. ..... 366/134
5,857,893 A * 1/1999 Olsen et al. ..... 451/5
6,024,829 A * 2/2000 Easter et al. ..... 156/345
6,053,802 A * 4/2000 Yi et al. ..... 451/60
6,059,920 A * 5/2000 Nojo et al. ..... 156/345

FOREIGN PATENT DOCUMENTS

| | | |
|---|---|---|
| EP | 0779647 A1 | 6/1997 |
| JP | 56-21771 | 2/1981 |
| JP | 59064276 | 4/1984 |
| JP | 6-106478 | 4/1994 |
| JP | 7-52031 | 2/1995 |
| JP | 7-164320 | 6/1995 |
| JP | 9-239661 | 9/1997 |
| SU | 1516313 | 10/1989 |
| WO | 9602319 | 2/1996 |
| WO | 98/06540 | 2/1998 |

* cited by examiner

*Primary Examiner*—Timothy V. Eley
*Assistant Examiner*—Dung Van Nguyen
(74) *Attorney, Agent, or Firm*—Wenderoth, Lind & Ponack, L.L.P.

(57) ABSTRACT

The object of the present invention is to provide a polishing apparatus that can supply a polishing solution having a non-varying distribution of abrading particles sizes at a steady rate. An apparatus (20) for delivering a polishing solution to a polishing apparatus (22) is disclosed. The apparatus (20) comprises: a solution passage for transporting the polishing solution; and an ultrasonic vibrator (72) being provided in at least one location of the solution passage.

34 Claims, 7 Drawing Sheets

POLISHING SOLUTION FEEDER

TECHNICAL FIELD

This invention relates to an apparatus for supplying a polishing solution for use in polishing, for example, a semiconductor substrate, and relates in particular to an apparatus for steadily supplying a polishing solution having a constant dispersion of abrading particles in the liquid.

BACKGROUND ART

Recent advances in circuit integration in semiconductor devices have produced micro-sized circuit patterns with narrow line widths. As a result, circuit pattern printing by optical lithography requires extremely shallow depth of focus, so that the substrate surface needs to be precisely flat in the focal plane of the stepper apparatus.

A method of obtaining a flat surface on a semiconductor substrate is to polish the wafer using a polishing tool (for example, polishing table with a polishing cloth), and a wafer holding member for holding and pressing the surface to be polished of the wafer against the polishing table, and moving the surface to be polished relative to the polishing tool while supplying a polishing solution at the contact interface between the polishing tool and the surface to be polished. Such a polishing apparatus can perform not only mechanical polishing using a polishing solution containing abrasive particles, but can also perform chemical polishing using an alkaline or acidic polishing solution. For example, a slurry for polishing an oxidized surface of the wafer is based on a KOH or $NH_4OH$ solution with a dispersion of silica particles.

To produce a good substrate using such a polishing apparatus, it is required that the polishing solution of a constant concentration be steadily supplied at a constant rate. A system for supplying a polishing solution has an undiluted solution tank to store a mixed solution of KOH, $NH_4OH$ and silica powder; a dilution tank to dilute the undiluted solution with pure water and others; and a supply piping to deliver the solution from the dilution tank to the nozzle of the polishing apparatus.

However, to meet the demand of cost reduction for equipment and operation, it is desired to supply the polishing solution from one tank to a plurality of polishing apparatuses, so that there is a tendency for long lengths of delivery piping. As a result, the polishing solution becomes stagnant inside the piping and tends to cause aggregation of abrasive particles so that the abrasive particles tend to cluster, thereby causing damage (scratch) to the substrate surface, thereby changing the amount of polishing as a result of changes in solution concentration, or thereby plugging the piping.

DISCLOSURE OF INVENTION

This invention is presented in view of the problems outlined above, and it is an object of the present invention to provide a polishing apparatus that can supply a polishing solution, having a non-varying distribution of abrading particle sizes, at a steady rate.

The invention includes an apparatus for delivering a polishing solution to a polishing apparatus, with the apparatus comprising: a solution passage for transporting the polishing solution; and an ultrasonic vibrator being provided in at least one location of the solution passage. Accordingly, clustered powder particles are dispersed by the ultrasonic vibration, so that a polishing solution, having a constant size distribution of fine powder particles in a given size range, can be delivered to the polishing apparatus. The dispersion effect of the treatment is retained for some time after applying the ultrasonic vibration, so that the particles are prevented from clustering while the solution is being delivered through the solution passage to reach the polishing apparatus.

The ultrasonic vibrator can be provided in a stock tank for storing an undiluted solution. The stock tank may be a storage tank for storing an undiluted solution delivered from an external source, or a tank to prepare a polishing solution by mixing powder particles and a solution to produce an undiluted solution or a polishing solution.

The solution passage may have a circulation passage for circulating the polishing solution and a delivery passage extending from the circulation passage to a polishing apparatus, and the ultrasonic vibrator can be provided on the circulation passage. Accordingly, non-stopping circulation of the polishing solution inside the solution passage prevents changes in the concentration of the solution or plugging in the passage caused by precipitated solid clusters of powder particles inside the passage. Also, one solution supply apparatus can deliver a polishing solution from one supply source to a number of polishing apparatuses, so that the apparatus cost can be lowered.

The ultrasonic vibrator can also be provided on the delivery passage. Also, the polishing solution may contain powder particles in a range of particle sizes between 0.1 to 0.2 $\mu$m.

The ultrasonic vibrator can be provided in a mixing section for mixing an undiluted solution and a dilution solution for adjusting a solution concentration.

The invention also includes a polishing apparatus which comprises a holding device for holding an object to be polished, a polishing tool opposing the holding device and a spray nozzle for introducing a polishing solution at an interface between the object to be polished and the polishing tool, wherein an ultrasonic vibrator is provided on those parts of the holding device and/or the polishing tool that retain the polishing solution.

BEST MODE FOR CARRYING OUT THE INVENTION

Figure 1:
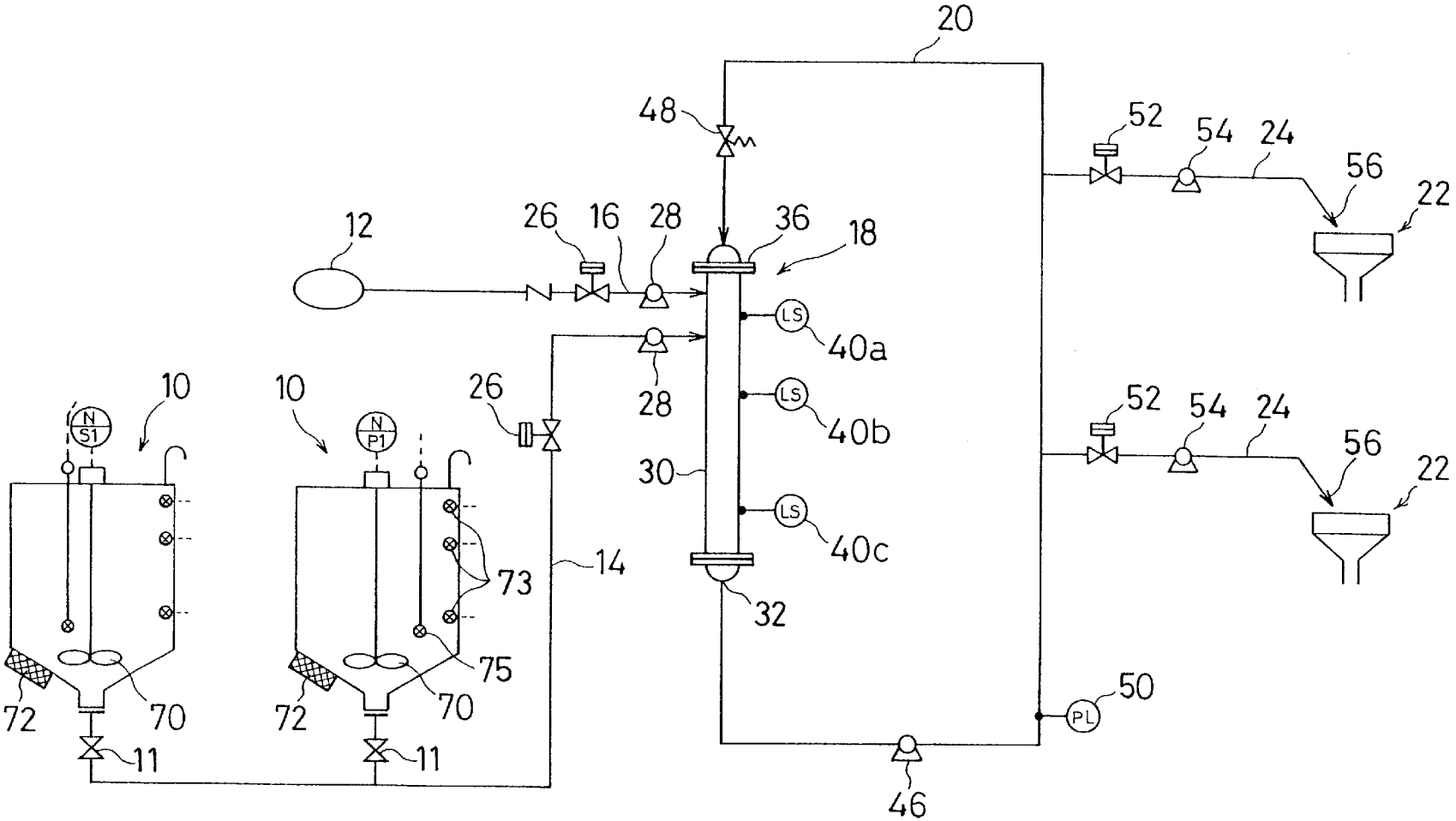
FIG. 1 is a diagram showing the overall configuration of the polishing solution supply apparatus of the present invention.

In the following, a first embodiment will be presented with reference to FIG. 1. This apparatus for delivering a polishing solution comprises: two stock tanks 10 for storing an undiluted solution; a dilution tank 12 for delivering a dilution solution to dilute the undiluted solution to a given concentration; a mixing section 18 for mixing the solutions supplied from the tanks through pipes 14, 16 to produce a polishing solution of a given concentration; a circulation passage 20 for circulating the polishing solution; and a delivery pipe 24 to supply the polishing solution from the circulation passage 20 to the polishing unit 22. Each stock tank 10 has a stirrer 70 inside, and a ultrasonic vibrator 72 is attached to a bottom section thereof. And, each stock tank 10 has a liquid level sensor 73, a temperature sensor 75 and others.

There are two stock tanks 10, and when one tank becomes empty, a valve 11 is opened to switch to the undiluted solution supply line 14. Each of the supply line 14 and the dilution liquid supply line 16 is connected to a buffer tube 18, which is a mixing section, through a respective shutoff valve 26 and flow adjusting valve 28, thereby producing a polishing solution of a given ratio inside the buffer tube 18.

The buffer tube 18 acting as the mixing section, in this embodiment, is disposed in a path of the circulation pipe 20 that supplies a polishing solution to a plurality of polishing units 22. The buffer tube 18 is a cylindrical container 30 of a diameter larger than that for the circulation pipe 20, is disposed vertically, and has a discharge opening 32 at the bottom section thereof, with a top section being covered by a lid 36 provided with an O-ring 34. A return pipe for the circulation pipe 20 and supply pipes 14, 16 for the undiluted solution and the dilution solution are connected to the buffer tube 18 at its top.

Container 30 is provided with liquid level sensors 40*a*, 40*b* and 40*c* for detecting upper, lower and lowermost levels, for example, and outputting respective signals to a controller (not shown). The controller outputs control signals to a shutoff valve 26 and a flow adjusting pump 28, so that the undiluted solution and the dilution solution will be supplied when the liquid level drops or the supply will be stopped when the liquid level reaches the upper level. If the liquid level should reach the lowermost level, the controller generates a warning signal or a stop signal for the polishing unit 22.

Circulation pipe 20 is constructed such that the solution exits from the discharge opening 32 at the bottom of the buffer tube 18, circulates near one or more polishing unit 22 for supplying polishing solution thereto, and then returns to the buffer tube 18 through the return pipe. Circulation pipe 20 is provided with a circulation pump 46 for circulating the polishing solution, a one-way valve(check valve) 48 for preventing a reverse flow, and a pressure sensor 50 and the like. An output signal from the pressure sensor is input to the controller, and the controller controls the operation of the circulation pump 46 according to the output signal of the pressure sensor so as to maintain the internal pressure in the circulation pipe 20 at a constant value. Circulation pipe 20 is branched into delivery pipes 24 near each polishing unit 22 to deliver the polishing solution thereto, and each delivery pipe 24 is connected, through a shutoff valve 52 and an adjustable flow pump 54, to a spray nozzle 56 directed at a certain location of each polishing unit 22.

Accordingly, by circulating the polishing solution at all times inside the piping to guide the solution to the neighborhood of the polishing unit 22, changes in solution concentration and line plugging caused by precipitated solid clusters from a stagnating polishing solution can be eliminated. Also, because the arrangement of the supply device permits the use of a long length of circulation piping, one supply source (mixing section) 18 can be used to supply a polishing solution, in a stable condition, and the cost of the overall facility can be reduced. Because each polishing unit 22 has its own working schedule, the polishing solution may become stagnant in some delivery pipes 24 in which the flow is stopped, but any adverse effects of stagnation can be eliminated by flowing a sufficient quantity of polishing solution to replace the stagnant liquid in the delivery pipes at the beginning of each operation.

Next, the effect that ultrasonic vibration applied to the solution has on the abrading particles or polishing qualities will be described with reference to FIGS. 2A through 4.

Figure 2A:
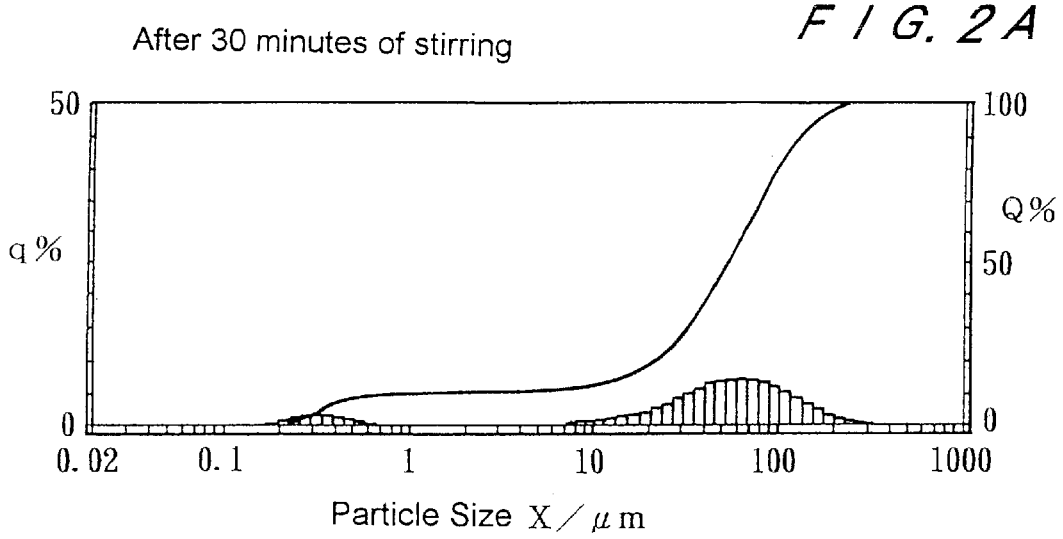
FIGS. 2A~2C are graphs showing the effects of ultrasonic processing.
Figure 2B:
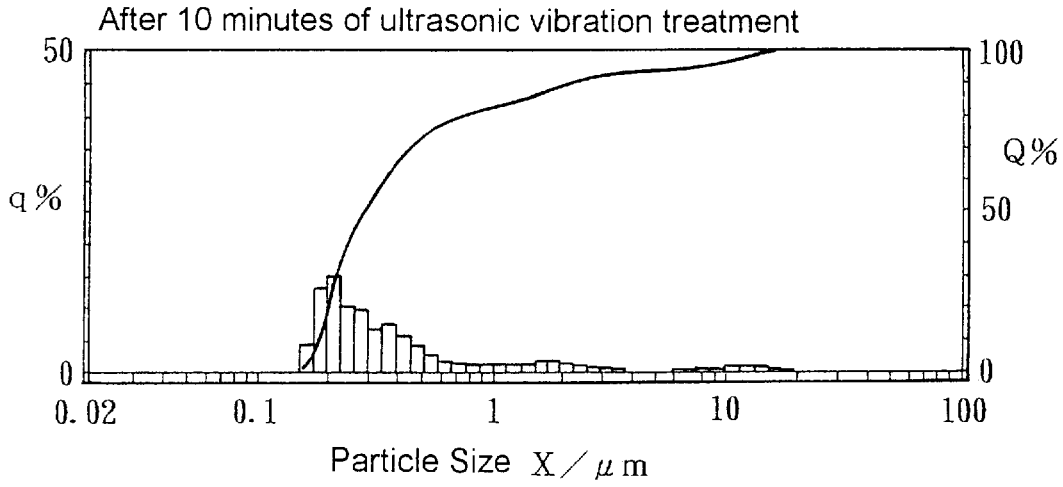
Figure 2C:
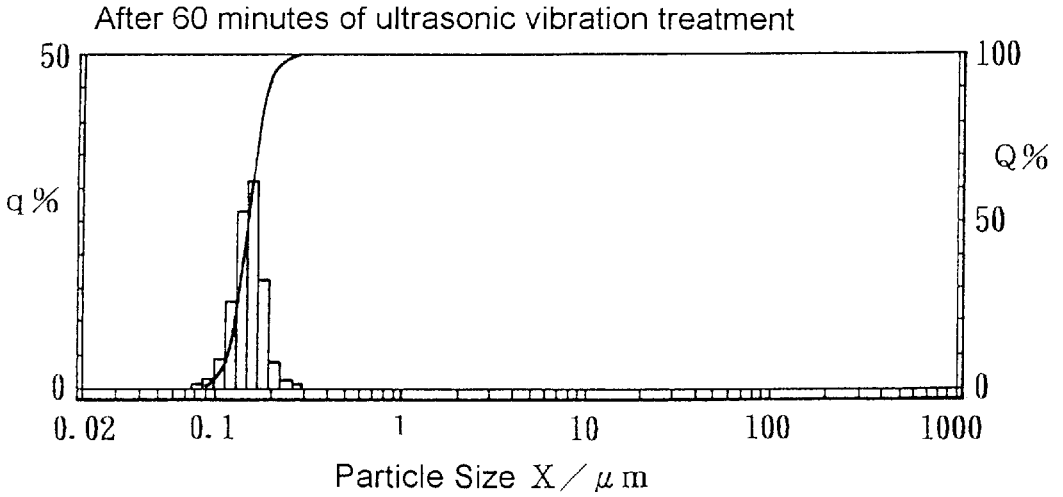

FIGS. 2A through 2C show an example of changes in the particle size distribution when vibrations are applied over a period of time. The stirrer 70 was operated for 30 minutes to produce a distribution of average particle size 51.7 $\mu$m, and a standard deviation 49.7 $\mu$m, as shown in FIG. 2A. After 10 minutes of ultrasonic vibration applied to the solution, an average particle size of 0.29 $\mu$m and a standard deviation 2.73 $\mu$m were obtained, as shown in FIG. 2B. After ultrasonic vibration applied to the solution for 60 minutes, an average particle size 0.15 $\mu$m and a standard deviation 0.029 $\mu$m were obtained, as shown in FIG. 2C. When vibration was applied longer than 60 minutes, further changes beyond those shown in FIG. 2C were not observed.

Figure 3A:
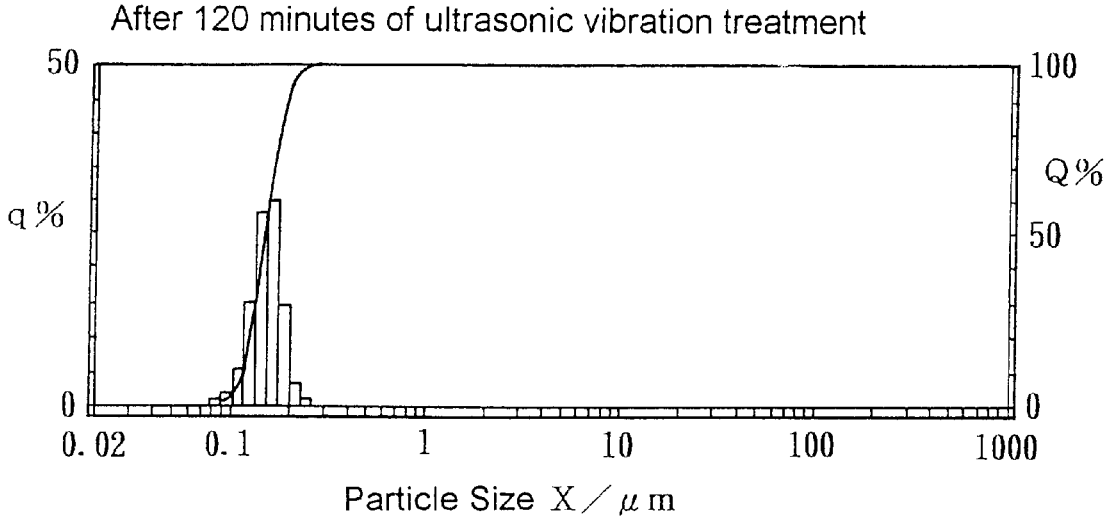
FIGS. 3A~3C are similar graphs showing the effects of ultrasonic processing.
Figure 3B:
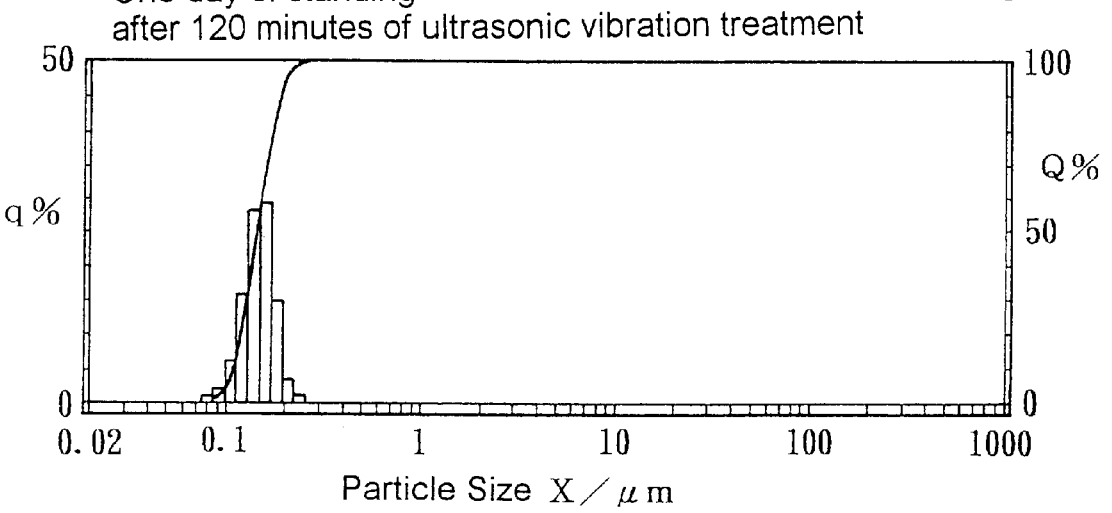
Figure 3C:
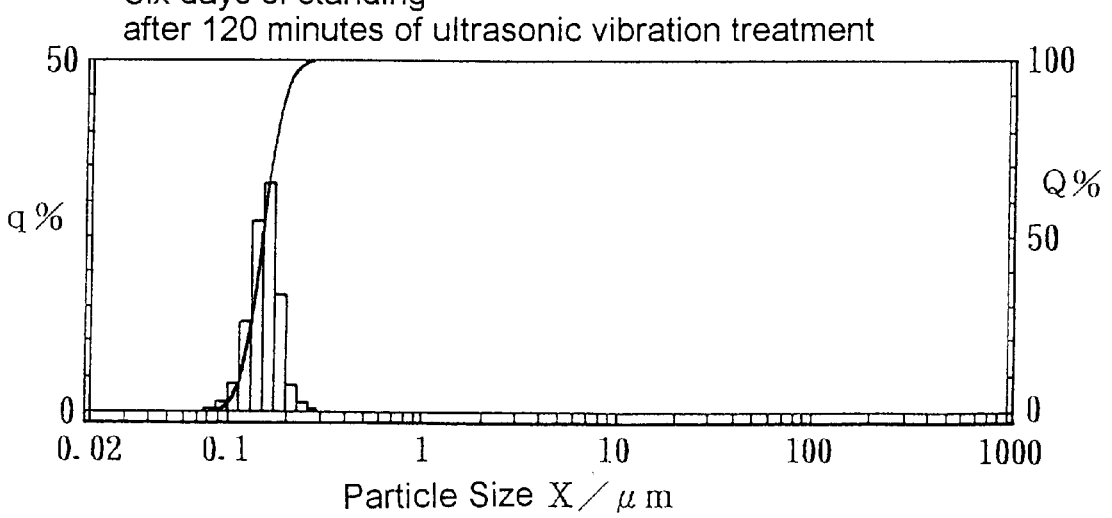

FIGS. 3A through 3C show changes in a particle size distribution observed when the vibrated solution was left standing. FIG. 3A shows the change after 120 minutes of standing, FIG. 3B shows the change after one day of standing, and FIG. 3C shows the change after six days of standing. The results indicated that the solution retains a fine particle size distribution for a considerable length of time after ultrasonic vibration is applied.

Figure 4:
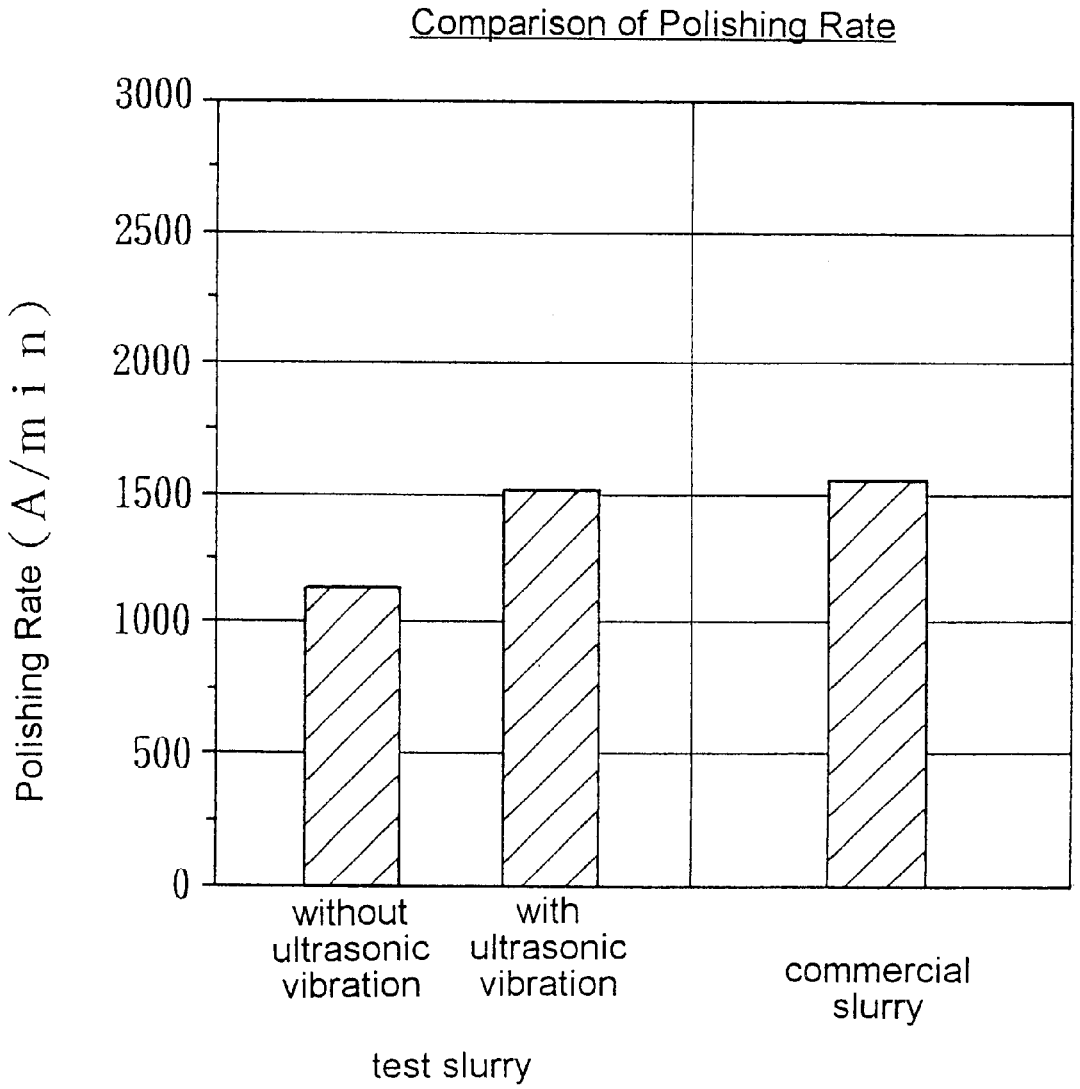
FIG. 4 is also a graph showing the effects of ultrasonic processing.

FIG. 4 shows a comparison of polishing performance of the solutions treated without ultrasonic vibrations and with ultrasonic vibrations, and a comparison with a commercial polishing solution containing silica powder. The results show that the polishing rate is increased when ultrasonic vibrations are applied because the particles become finely dispersed. The results also show that the polishing rates of a test slurry subjected to vibrations are about the same for a commercial polishing slurry. The results observed in FIGS. 2A through 4 regarding the effects of ultrasonic vibration treatment on the particle size distribution and polishing capability, were applied to the polishing solution supply apparatus in this embodiment.

The operation of the polishing solution supply apparatus will be explained below. The stock tank 10 is opened by lifting a lid, and a silica powder and given quantities of polishing liquids such as KOH, $NH_4OH$ are added and stirred with the stirrer 70 to disperse the abrading (silica) particles. Concurrently with stirring or after stirring for a given time, the ultrasonic vibrator 72 is operated for a given interval. This step disperses clustered powder particles that exhibited a relatively wide range of particle sizes, and produces a particle size distribution centered about a narrow range of fine particle sizes. The processing interval and frequency of the application of ultrasonic vibration are governed by the size of the tanks 10. For example, ultrasonic vibration may be carried out in a regular pattern, for example, for two minutes continuously over a period of sixty minutes or five minutes continuously over a period of thirty minutes.

Next, by operating the pumps 28 an a polishing solution of a given mixture ratio is produced. The control device controls the circulation pump 46 so that the downstream pressure is maintained above a certain value, and a steady circulating flow of polishing solution in the circulation passage 20 is generated.

When the individual polishing units 22 are operated, a portion of the polishing solution is delivered through the respective delivery pipes 24 into the nozzles 56 of the respective polishing units 22. When the solution level inside the buffer tube 18 becomes lower than the lower limit, the level sensor 40*b* sends a signal to the control device to open the valves 26, whereby the undiluted solution and pure water, whose flow rates are controlled by the flow control valves 26, are supplied to the buffer tube 18 at a constant mixing ratio, until the liquid level reaches the upper limit. In this step, because the undiluted solution has been treated by ultrasonic vibration for a given length of time in the stock tank 10, silica is less likely to aggregate.

Figure 5:
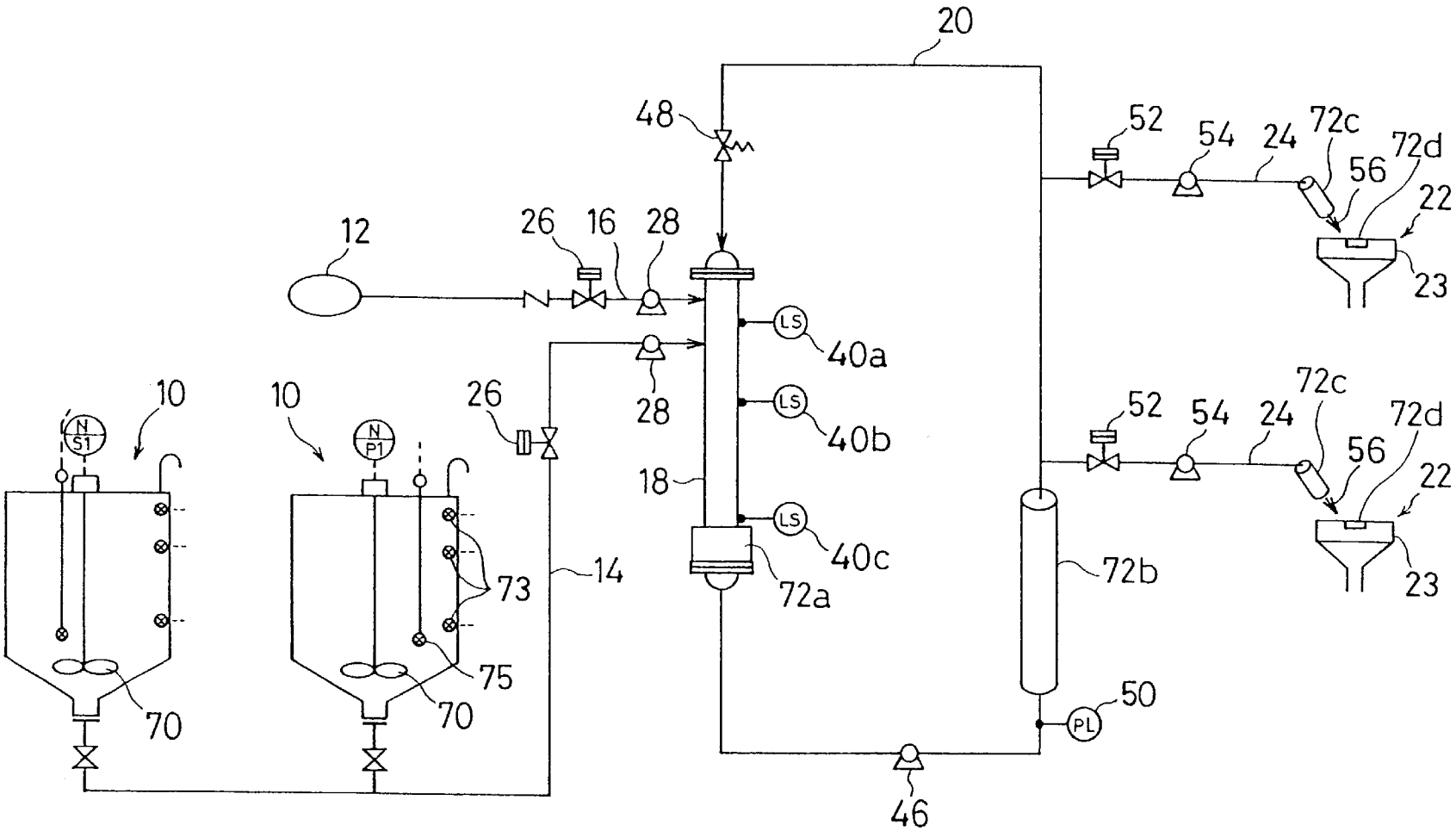
FIG. 5 shows another embodiment of the polishing solution supply apparatus.

FIG. 5 shows another embodiment of this invention, in which the ultrasonic vibrators are provided at various locations in the supply passage. For example, vibrators 72*a*, 72*b*, 72*c*, 72*d* of suitable sizes and shapes are applied at one or more locations including the mixing section (buffer tube) 18 for the undiluted solution and dilution solution, circulation pipe 20, near the nozzle 56, and on the turntable 23.

Figure 6A:
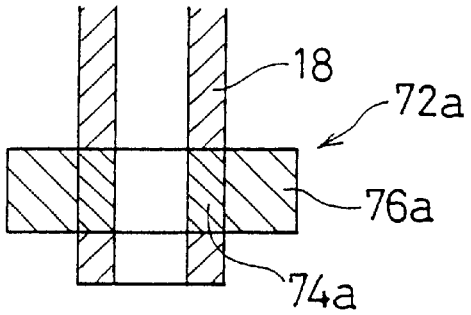
FIGS. 6A~6C are various views of the structures of the ultrasonic vibration device shown in FIG. 5.
Figure 6B:
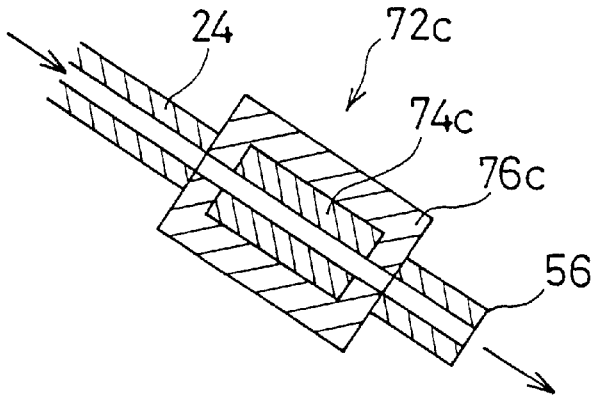
Figure 6C:
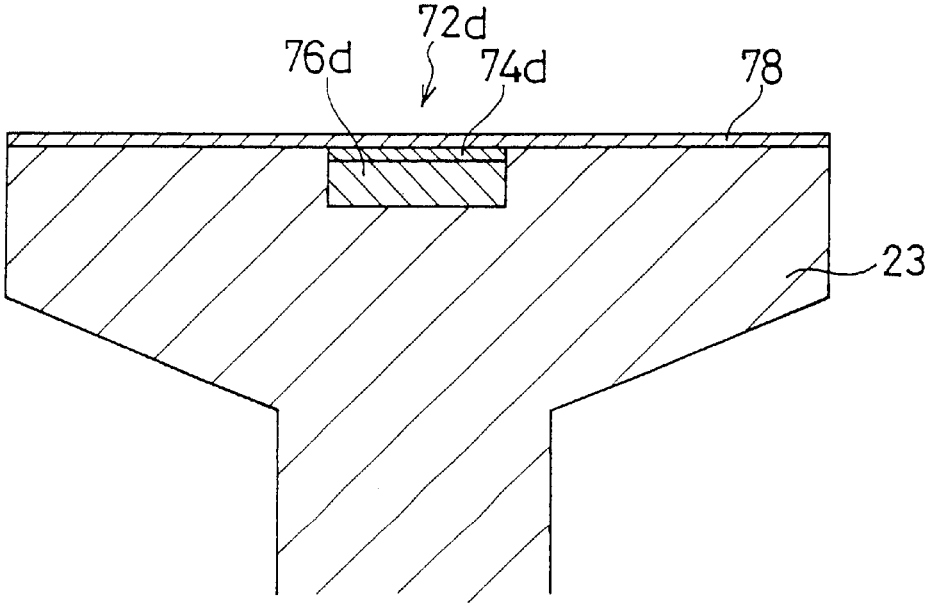

FIGS. 6A through 6C show details of attaching the vibrators 72*a*, 72*b*, 72*c*, 72*d*. As shown in each diagram, the vibrators 72*a* through 72*d* comprise ultrasonic elements 74*a* through 74*d* and ultrasonic oscillators 76*a* through 76*d*. FIG. 6A shows an installation of the vibrator 72*a* on the bottom section of the buffer tube 18. Vibrator 72*b* is similarly disposed about the circulation pipe 20. FIG. 6B shows the vibrator 72*c* installed near the tip of the nozzle 56 which directs polishing solution onto the turntable 23. Vibrators 72*a* through 72*c* can be installed in any suitable place on the buffer tube 18 and each piping.

FIG. 6C shows a cross sectional view of the ultrasonic vibrator 72*d* imbedded in the turntable 23. The vibrator 72*d* is imbedded near the center of the abrading surface of the turntable underneath a polishing pad 78. In this embodiment, the vibrator is imbedded near the center, but the location of the vibrator 72*d* may be underneath and off-center near the location of supply of solution on the turntable, or near the pressing point for polishing the wafer.

In these embodiments, the solution can be supplied on the turntable 23 in a well dispersed state, because the point of solution delivery is a downstream location of the solution flow, or close to the location where the solution is actually being applied to the wafer. Also, even when the polishing units 22 are stopped and the solution flow rate drops or the solution becomes stagnant, particle clustering is less likely to occur. In this embodiment, additional ultrasonic vibrations are applied to locations other than the stock tank, so that, compared with the case of applying the ultrasonic vibrations only at the stock tank, clustering can be prevented even if the size of the apparatus for supplying the polishing solution is increased.

Figure 7:
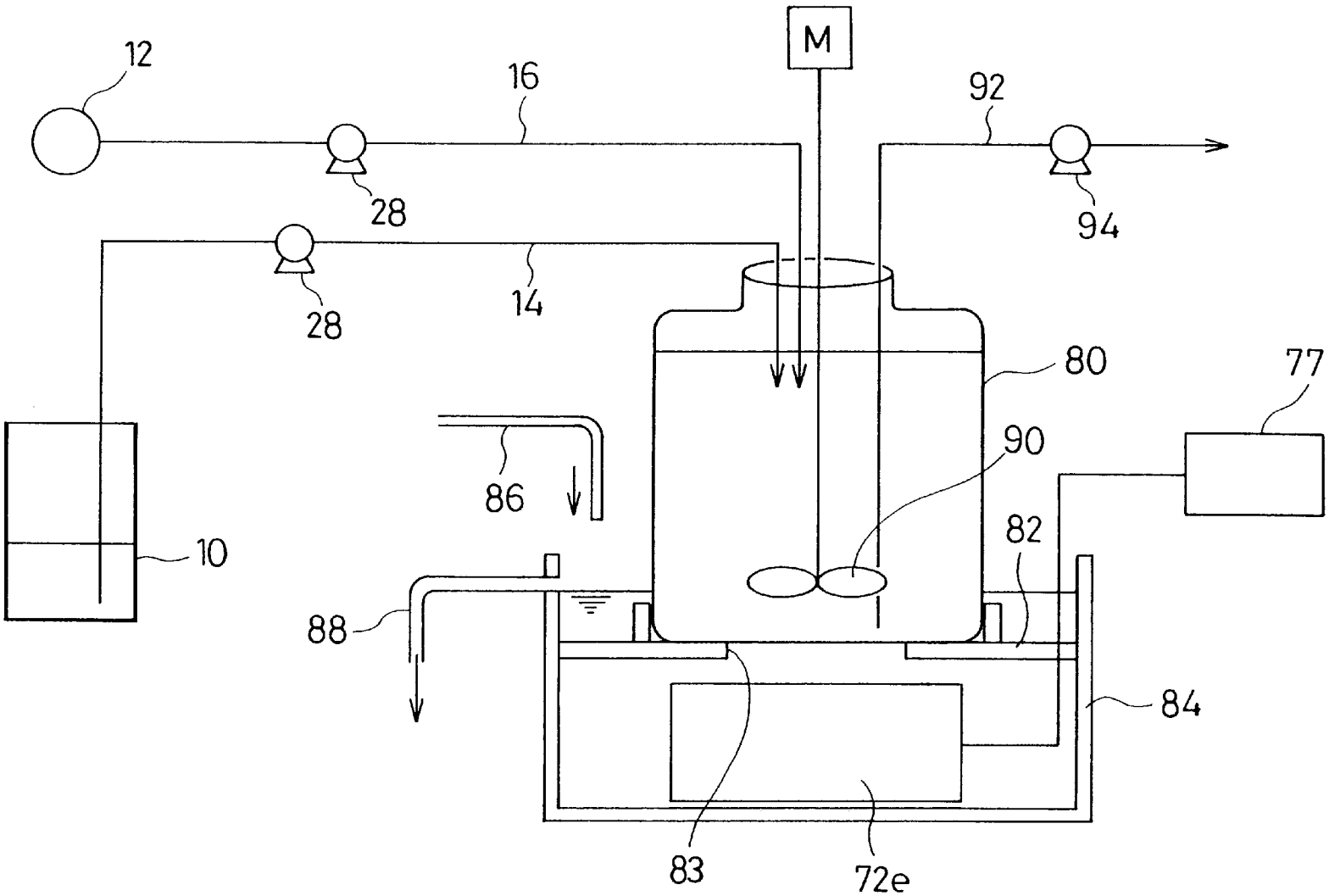
FIG. 7 is a schematic view of another embodiment of the polishing solution supply apparatus.

FIG. 7 shows an arrangement when there are not enough polishing units 22 to justify a circulation pipe 20, so that the buffer tube may be replaced with a supply bottle 80.

The supply bottle 80 is held in a water tank 84 by virtue of a support 82, and the water tank 84 is provided with a water supply pipe 86 to constantly supply water and a discharge pipe 88 to maintain the water level constant so as to keep the bottom of the supply bottle 80 always under water. An immersion type ultrasonic vibrator 72*e* is immersed in the water tank 84 located directly below the water bottle 80. The vibrator 72*e* is controlled by a controller 77 located outside of the water tank 84. An opening section 83 is cut out of the support 82 between the supply bottle 80 and the vibrator 72*e*, so that ultrasonic waves generated from the vibrator 72*e* impact the bottom of the supply bottle 80 through the opening section 83. A stirrer 90 is introduced into the supply bottle 80 from a top opening thereby and attached to the supply bottle 80, so as to enable stirring of the solution while the bottom of the supply bottle 80 is subjected to ultrasonic vibrations. The material for making the supply bottle 80, water tank 84, and support 82 includes resins, quartz glass, stainless steels and resin coated metals. Although not shown in the drawing, it is preferable that the supply bottle 80 is provided with a lid so as to prevent solution evaporation and reaction with the environment.

In this embodiment, the undiluted solution and the dilution solution are pumped individually to the supply bottle 80 from respective supply sources 10, 12 by pumps 28. A polishing solution prepared at a certain concentration in the supply bottle 80 is stirred and ultrasonically vibrated as necessary to generate a dispersion of the powder in the solution as previously described. The solution is delivered to polishing units through one or more delivery pipes 92 by a slurry pump 94.

As explained above, according to this invention, a polishing solution having a constant distribution of polishing particle size can be delivered to polishing units by dispersing the agglomerated powder particles by subjecting the solution to go ultrasonic vibration. It follows that polishing can be performed in a stable manner by preventing surface scratches caused by aggregated power particles, or by preventing changes of polishing rate caused by changes in the particle concentration.

Industrial Applicability

This invention is useful as an apparatus for delivering a polishing solution to a polishing apparatus for manufacturing, for example, semiconductor devices which are highly integrated.

What is claimed is:

1. An apparatus for delivering a polishing solution to a polishing device, comprising:

a solution passage for transporting a polishing solution, with said solution passage including a circulation passage for circulating the polishing solution and a delivery passage extending from said circulation passage to a polishing device; and an ultrasonic vibrator provided at at least one of said circulation passage and said delivery passage.

2. An apparatus for delivering a polishing solution to a polishing device, comprising:

a solution passage for transporting a polishing solution, with said solution passage including a mixing section for mixing an undiluted solution and a dilution solution to adjust a polishing solution concentration; and an ultrasonic vibrator provided at said mixing section.

3. A polishing apparatus comprising:

a solution passage for transporting a polishing solution, with said solution passage including a stock tank for stocking an undiluted solution;

an ultrasonic vibrator provided at said stock tank;

a holding device for holding an object to be polished;

a polishing tool to be opposed to said holding device;

a nozzle for supplying the polishing solution onto said polishing tool; and a vibrator positioned in said polishing tool.

4. The apparatus according to claim 3 wherein said vibrator positioned in said polishing tool comprises an ultrasonic vibrator positioned in said polishing tool.

5. The apparatus according to claim 4, wherein said polishing tool includes an abrading surface, and wherein said polishing tool is to be opposed to said holding device by having said abrading surface be opposed to said holding device.

6. The apparatus according to claim 5, wherein said ultrasonic vibrator is positioned in said polishing tool by being positioned beneath said abrading surface.

7. The apparatus according to claim 6, wherein said abrading surface includes a polishing pad provided on an upper surface of said polishing tool, and wherein said ultrasonic vibrator is positioned beneath said abrading surface by being positioned beneath said polishing pad.

8. The apparatus according to claim 3, wherein said polishing tool includes an abrading surface, and wherein said polishing tool is to be opposed to said holding device by having said abrading surface be opposed to said holding device.

9. The apparatus according to claim 8, wherein said vibrator is positioned in said polishing tool by being positioned beneath said abrading surface.

10. The apparatus according to claim 9, wherein said abrading surface includes a polishing pad provided on an upper surface of said polishing tool, and wherein said vibrator is positioned beneath said abrading surface by being positioned beneath said polishing pad.

11. A polishing apparatus comprising:

a solution passage for transporting a polishing solution, with said solution passage including a circulation passage for circulating the polishing solution and a delivery passage extending from said circulation passage to a polishing device; and an ultrasonic vibrator provided at at least one of said circulation passage and said delivery passage, wherein said polishing device includes a holding device for holding an object to be polished, a polishing tool to be opposed to said holding device, a nozzle for supplying the polishing solution onto said polishing tool, and a vibrator positioned in said polishing tool.

12. The apparatus according to claim 11, wherein said vibrator positioned in said polishing tool comprises an ultrasonic vibrator positioned in said polishing tool.

13. The apparatus according to claim 12, wherein said polishing tool includes an abrading surface, and wherein said polishing tool is to be opposed to said holding device by having said abrading surface be opposed to said holding device.

14. The apparatus according to claim 13, wherein said ultrasonic vibrator is positioned in said polishing tool by being positioned beneath said abrading surface.

15. The apparatus according to claim 14, wherein said abrading surface includes a polishing pad provided on an upper surface of said polishing tool, and wherein said ultrasonic vibrator is positioned beneath said abrading surface by being positioned beneath said polishing pad.

16. The apparatus according to claim 11, wherein said polishing tool includes an abrading surface, and wherein said polishing tool is to be opposed to said holding device by having said abrading surface be opposed to said holding device.

17. The apparatus according to claim 16, wherein said vibrator is positioned in said polishing tool by being positioned beneath, said abrading surface.

18. The apparatus according to claim 17, wherein said abrading surface includes a polishing pad provided on an upper surface of said polishing tool, and wherein said vibrator is positioned beneath said abrading surface by being positioned beneath said polishing pad.

19. A polishing apparatus comprising:

a solution passage for transporting a polishing solution, with said solution passage including a mixing section for mixing an undiluted solution and a dilution solution to adjust a polishing solution concentration;

an ultrasonic vibrator provided at said mixing section;

a holding device for holding an object to be polished;

a polishing tool to be opposed to said holding device;

a nozzle for supplying a polishing solution onto said polishing tool; and a vibrator positioned in said polishing tool.

20. The apparatus according to claim 19, wherein said vibrator positioned in said polishing tool comprises an ultrasonic vibrator positioned in said polishing tool.

21. The apparatus according to claim 20, wherein said polishing tool includes an abrading surface and wherein said polishing tool is to be opposed to said holding device by having said abrading surface be opposed to said holding device.

22. The apparatus according to claim 21, wherein said ultrasonic vibrator is positioned in said polishing tool by being positioned beneath said abrading surface.

23. The apparatus according to claim 22, wherein said abrading surface includes a polishing pad provided on an upper surface of said polishing tool, and wherein said ultrasonic vibrator is positioned beneath said abrading surface by being positioned beneath said polishing pad.

24. The apparatus according to claim 19, wherein said polishing tool includes an abrading surface, and wherein said polishing tool is to be opposed to said holding device by having said abrading surface be opposed to said holding device.

25. The apparatus according to claim 24, wherein said vibrator is positioned in said polishing tool by being positioned beneath said abrading surface.

26. The apparatus according to claim 25, wherein said abrading surface includes a polishing pad provided on an upper surface of said polishing tool, and wherein said vibrator is positioned beneath said abrading surface by being positioned beneath said polishing pad.

27. A polishing apparatus comprising:

a polishing device including a holding device for holding an object to be polished, a polishing tool to be opposed to said holding device, a nozzle for supplying a polishing solution onto said polishing tool, and a vibrator positioned in said polishing tool;

a store section for storing a solution, said store section including at least one of a stock section for storing an undiluted solution and a mixing section for mixing an undiluted solution and a dilution solution to adjust a polishing solution concentration;

a solution passage for transporting a polishing solution from said store section to said dishing device; and a vibrator positioned at said store section.

28. The apparatus according to claim 27, wherein said vibrator positioned in said polishing tool comprises an ultrasonic vibrator positioned in said polishing tool, and said vibrator positioned at said store section comprises an ultrasonic vibrator positioned at said store section.

29. The apparatus according to claim 28, wherein said polishing tool includes an abrading surface, and wherein said polishing tool is to be opposed to said holding device by having said abrading surface be opposed to said holding device.

30. The apparatus according to claim 29, wherein said ultrasonic vibrator is positioned in said polishing tool by being positioned beneath salty abrading surface.

31. The apparatus according to claim 30, wherein said abrading surface includes a polishing pad provided on an upper surface of said polishing tool, and wherein said ultrasonic vibrator is positioned beneath said abrading surface by being positioned beneath said polishing pad.

32. The apparatus according to claim 27, wherein said polishing tool includes an abrading surface, and wherein said polishing tool is to be opposed to said holding device by having said abrading, surface be opposed to said holding device.

33. The apparatus according to claim 32, wherein said vibrator is positioned in said polishing tool by being positioned beneath said abrading surface.

34. The apparatus according to claim 33, wherein said abrading surface includes a polishing pad provided on an upper surface of said polishing tool, and wherein said vibrator is positioned beneath said abrading surface by being positioned beneath said polishing pad.

* * * * *